United States Patent [19]

Müller

[11] 4,392,277

[45] Jul. 12, 1983

[54] LOCK TONGUE FOR SAFETY BELTS

[75] Inventor: Manfred Müller, Deizisau, Fed. Rep. of Germany

[73] Assignee: Daimler-Benz Aktiengesellschaft, Fed. Rep. of Germany

[21] Appl. No.: 271,360

[22] Filed: Jun. 8, 1981

[30] Foreign Application Priority Data

Jun. 6, 1980 [DE] Fed. Rep. of Germany ..... 3021387

[51] Int. Cl.[3] ..... A44B 11/10

[52] U.S. Cl. ..... 24/196

[58] Field of Search ..... 24/196, 168

[56] References Cited

U.S. PATENT DOCUMENTS

| | | | |
|---|---|---|---|
| 629,906 | 8/1899 | Kerngood | 24/196 |
| 1,838,827 | 12/1931 | Hart | 24/196 |
| 3,148,427 | 9/1964 | Hoffstrom | 24/196 |

*Primary Examiner*—Hugh R. Chamblee

*Attorney, Agent, or Firm*—Craig & Burns

[57] ABSTRACT

A lock tongue for safety belts with a belt strap of the safety belt being adapted to pass through the lock tongue and be firmly attached to the belt strap so as to be safe against displacement at a certain location of the belt strap due to a loop-around friction occuring under load. The attachment is effected by repeated deflection of the belt strap by means of a component separate from the lock tab or tongue cooperating with the later. The lock tab or tongue includes two passage openings which are separated from each other by a central web, with the passage openings being adapted to accommodate the belt strap. A clamping bracket may be attached, preferably in a releasable fashion, into one of the passage openings. The clamping bracket bridges the passage opening and extends along an entire longitudinal extension of the passage opening and rests on both sides in marginal zones of the lock tab or tongue adjoining the narrow sides of the passage opening, wherein the clamping bracket serves for supporting the belt strap extended therearound.

6 Claims, 3 Drawing Figures

LOCK TONGUE FOR SAFETY BELTS

The present invention relates to a lock arrangement and, more particularly, to a lock tongue or tab for safety belts, with a belt strap passing through the tongue so as to enable the tongue to be firmly attached and safe against displacement at a certain location of the belt strap due to a loop around friction occuring under load, and with the attachment being effected by repeated deflection of the belt strap by means of a component separate from the lock tab but cooperating therewith.

A lock tongue or tab of the aforementioned type is proposed in, for example, Auslegeschrift No. 1,166,529, wherein the lock tongue or tab is intended for arrangement at a free end of, for example, a slanted shoulder belt so as to enable a possible adjustment of the belt length to the physical dimensions and seating position of a belt user. In this proposed construction, an auxiliary eye is required for attachment and is provided with three webs. A disadvantage of this proposed construction resides in the fact that the auxiliary eye is relatively expensive to manufacture. Moreover, the auxiliary eye can only be placed onto a free belt end and once in place cannot be readily removed therefrom.

In contrast to the above noted proposed construction, the present invention seeks to solve an entirely different problem. More particularly, in the case of passenger motor vehicles equipped with three point safety belts, especially with safety belts in the rear seats, the idea actually presented itself readily to employ these belts, if necessary, also for an attachment of safety devices such as, for example, childrens restraints, i.e., specially constructed children's seats. However, due to the provision of the freely displaceable lock tab or tongue on the endless belt of the three-point safety belt system, it was not easily possible to provide for attachement of the additional restraints and, generally, it was necessary to fixedly fasten or screw separate straps to suitable locations of the vehicle for attachment of the children's seats. A disadvantage of providing separate straps resides in the fact that such separate straps represent a considerable expenditure. Moreover, for example, a not so insignificant difficulty is encountered in arranging and designing the additional mounting points for the separate straps in such a manner so as not to be a disturbing factor in the appearance of the vehicle when it was resold or when the child's safety devices were no longer needed.

The aim underlying the present invention essentially resides in providing a possiblity for attaching a child's safety or restraint device by way of a customary lock tongue or tab of a three-point safety belt system quickly and without any large expenditure due to additional structural parts in the vehicle.

In accordance with advantageous features of the present invention, a lock tongue or tab is provided having two passage openings for a belt strap of the safety belt system, with the openings being separated from each other by a central web or bridge. A clamping bracket or buckle is provided which may, preferably, be attached in a releasable fashion to one of the passage openings. The clamping bracket or buckle bridges an entire longitudinal extension of the passage opening and is supported on both sides in marginal zones of the lock tab or tongue adjoining narrow sides of the passage opening, wherein the clamping bracket or buckle serves for supporting the belt strap guided therearound.

By virtue of the features of the present invention, it is merely necessary to, for example, mount a belt lock at the child's seat which lockingly cooperates with the lock tab in the usual manner.

Advantageously, in accordance with the present invention, the clamping bracket has an approximately mushroom-shaped cross section, wherein a base portion of the mushroom extends into a zone of the passage opening.

In order to attain an especially secure mounting of the belt strap, a width of the base portion of the mushroom is somewhat smaller than a length of the narrow sides of the passage opening, minus three times a thickness of the belt strap.

Preferably, in accordance with the present invention, a width of the head portion of the mushroom should correspond approximately to a length of the narrow sides of the passage opening.

To achieve an especially simple mounting and dismounting of the clamping bracket, in accordance with further features of the present invention, the clamping bracket is attachable to the lock tongue or tab by way of a hook or the like articulated to the clamping bracket.

Accordingly, it is an object of the present invention to provide a lock tab or tongue for a safety belt system which avoids, by simple means, shortcomings and disadvantages encountered in the prior art.

Another object of the present invention resides in providing a lock tab or tongue for a safety belt system which enables a simple attachment and removal of additional restraint or safety devices.

Yet another object of the present invention resides in providing a lock tab or tongue for a safety belt system which enables attachment of an additional restraint or safety device without requiring the use of additional expensive structural parts.

A further object of the present invention resides in providing a lock tab or tongue for a safety belt system which enables an attachment of additional restraint or safety devices without altering appearance of a vehicle when the additional restraint or safety device is removed.

A still further object of the present invention resides in providing a lock tab or tongue for a safety belt system which is simple in construction and therefore relatively inexpensive to manufacture.

Another object of the present invention resides in providing a lock tab or tongue which ensures a safe mounting of additional safety or restraint systems.

These and other objects, features, and advantages of the present invention will become more apparent from the following description when taken in connection with the accompanying drawings which shows, for the purposes of illustration only, one embodiment in accordance with the present invention, and wherein.

Figure 1:
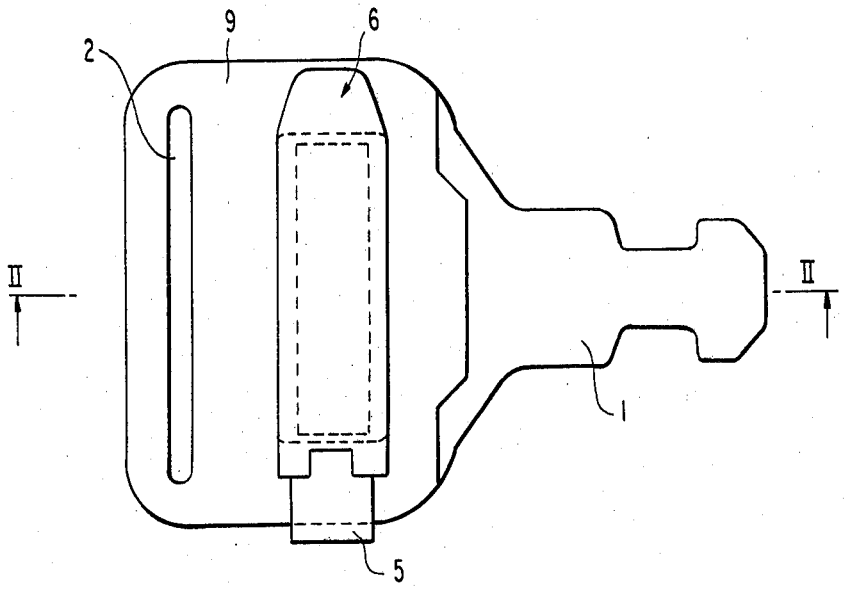
FIG. 1 is a top view of a lock tongue or tab of a safety belt system constructed in accordance with the present invention without a belt strap mounted thereto.
Figure 2:
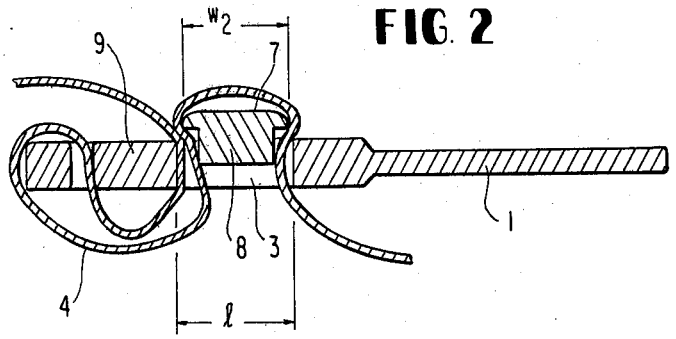
FIG. 2 is a cross sectional view taken along the line II—II in FIG. 1 with a belt strap of a belt system being pulled therethrough.

Referring now to the drawings wherein like reference numerals are used in both views to designate like parts and, more particularly, to FIGS. 1 and 2, according to these figures, the lock tab 1 includes two passage openings 2, 3 for accommodating a belt strap of a safety belt system. The passage openings 2, 3 are separated from each other by a central web 9.

Figure 3:
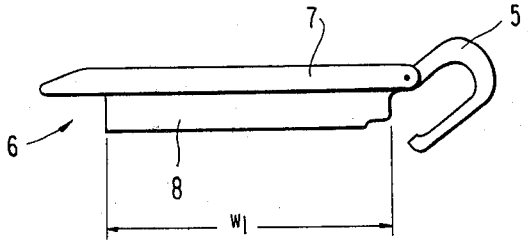
FIG. 3 is a lateral view, on an enlarged scale, of a clamping bracket or buckle of the present invention.

As shown most clearly in FIGS. 2 and 3, a hook, preferably consisting of an elastic material, is provided for attaching a bracket or buckle generally designated by the reference numeral 6 into the passage opening 3. The passage opening 3 has a larger width than a width of the bracket or buckle 6. The clamping bracket 6 has a stem or base portion 8 and a wide head portion 7 such that the clamping bracket 6 has an approximately mushroom-shaped cross section. The clamping bracket 6 bridges or extends over an entire longitudinal extension of the passage opening 3 and is supported on both sides in marginal zones of the lock tab 1 adjoining the narrow sides of the passage opening 3.

Advantageously, a width $W_1$ (FIG. 3) of the base of stem portion 8 is somewhat less than a length l (FIG. 2) of the narrow sides of the passage opening 3 and, preferably, by less than three times a thickness of the belt strap 4. Additionally, a width $W_2$ of the head portion 7 corresponds approximately to the length l of the narrow sides of the passage opening 3.

In a normal in-use position of the lock tongue or tab 1, that is with the clamping bracket 6 not being mounted in the passage opening 3, the lock tongue or tab 1 is rotated by 180° as compared with the illustrated position. In other words, a region of the lock tongue or tab 1 serving for an insertion into a belt latch (not shown) would point toward the left, and the belt strap 4 would pass simply through each of the passage openings 2, 3.

For an attachment of a safety device such as, for example, a child's restraint (not shown), the lock tab 1, initially oriented downwardly in the motor vehicle, is flipped upwardly, and the belt strap 4, coming from above, is inserted in the form of a loop through the passage opening 3. The clamping bracket 6 is then pushed through the loop and, by tightening the belt strap 4, due to the thus-occuring loop-around friction, a frictional-type fixation of the lock tab or tongue 1 is obtained. A necessary second attachment (not shown) of the child's restraint takes place at the lock of the backseat belt through a further lock tab or tongue (not shown) attached to the child's restraint.

While I have shown and described only one embodiment in accordance with the present invention, it is understood that the same is not limited thereto but is susceptible of numerous changes and modifications as are known to one having ordinary skill in the art and I therefore do not wish to be limited to the details shown and described herein, but intend to cover all such modifications as are encompassed by the scope of the appended claims.

I claim:

1. A lock tongue for a safety belt system, comprising two passage openings for accommodating a belt strap of the safety belt system, a central web means for separating the two passage openings, and clamping means adapted to be attached in one of the passage openings for clamping the belt strap, the clamping means extending along an entire longitudinal extension of the passage opening so as to rest on both sides in marginal zones of the lock tongue adjoining narrow sides of the passage opening so that the clamping means supports the belt strap extended therearound when the clamping means is in the passage opening, the belt strap passes through the passage openings so that the lock tongue is firmly attachable in a certain location of the belt strap due to a loop around friction occurring under load, the attachment of the lock tongue is effected by repeated deflection of the belt strap by the clamping means, the clamping means includes a clamping bracket having a base portion and a head portion, the head portion has a width wider than a width of the base portion such that the bracket has an approximately mushroom-shaped cross section, the base portion is adapted to be inserted into the passage opening, the width of the base portion is less than the length of the narrow sides of the passage opening by about three times a thickness of the belt strap, a width of the head portion corresponds approximately to the length of the narrow sides of the passage opening, and means are provided for attaching the clamping bracket to the lock tongue.

2. The lock tongue according to claim 1, wherein the attaching means includes a hook portion arranged on the clamping bracket.

3. The lock tongue according to claim 2, wherein the hook portion is fashioned of an elastic material and is articulated to the clamping bracket.

4. The lock tongue according to claim 1, wherein the clamping means includes a clamping bracket, and means are provided for attaching the clamping bracket to the lock tongue.

5. The lock tongue according to claim 4, wherein the attaching means includes a hook portion arranged on the clamping bracket.

6. The lock tongue according to claim 5, wherein the hook portion is fashioned of an elastic material and is articulated to the clamping bracket.

* * * * *